US011109723B2

(12) United States Patent
Rosenthal

(10) Patent No.: US 11,109,723 B2
(45) Date of Patent: Sep. 7, 2021

(54) TOILET BRUSH ASSEMBLY

(71) Applicant: ROM Innovations Ltd., Rishon LeZion (IL)

(72) Inventor: Tal Rosenthal, Rishon LeZion (IL)

(73) Assignee: ROM Innovations Ltd., Rishon Lezion (IL)

( * ) Notice: Subject to any disclaimer, the term of this patent is extended or adjusted under 35 U.S.C. 154(b) by 0 days.

(21) Appl. No.: 17/193,791

(22) Filed: Mar. 5, 2021

(65) Prior Publication Data

US 2021/0186279 A1 Jun. 24, 2021

Related U.S. Application Data

(63) Continuation of application No. PCT/US2020/061965, filed on Nov. 24, 2020.

(60) Provisional application No. 62/942,220, filed on Dec. 2, 2019.

(51) Int. Cl.

| | |
|---|---|
| ***A47K 17/00*** | (2006.01) |
| ***A46B 11/00*** | (2006.01) |
| ***A46B 9/02*** | (2006.01) |

(52) U.S. Cl.

CPC ..... *A47K 17/00* (2013.01); *A46B 9/026* (2013.01); *A46B 11/0062* (2013.01); *A46B 11/0068* (2013.01); *A46B 2200/304* (2013.01)

(58) Field of Classification Search

CPC ..... A47K 11/00; A47K 11/10; A47K 17/00; A46B 9/026; A46B 11/00; A46B 11/001; A46B 11/0062; A46B 11/0068; A46B 2200/304

USPC ..... 15/132, 143.1

See application file for complete search history.

(56) References Cited

U.S. PATENT DOCUMENTS

| | | | | |
|---|---|---|---|---|
| 2002/0054784 | A1* | 5/2002 | Wolf | A46B 11/0003 401/282 |
| 2004/0141794 | A1* | 7/2004 | Slaboden | A47K 11/10 401/88 |
| 2005/0074275 | A1* | 4/2005 | Hart | A47K 11/10 401/279 |
| 2011/0225751 | A1 | 9/2011 | Chapman et al. | |
| 2011/0253180 | A1 | 10/2011 | Davidson | |
| 2014/0137357 | A1 | 5/2014 | Ralea | |
| 2014/0331425 | A1 | 11/2014 | Baker | |
| 2015/0374183 | A1 | 12/2015 | Henry | |

(Continued)

FOREIGN PATENT DOCUMENTS

| | | |
|---|---|---|
| CN | 203263267 U | 11/2013 |
| CN | 108143339 A | 6/2018 |

(Continued)

OTHER PUBLICATIONS

EP-0005685A1 translation Espacenet (Year: 2021).*

(Continued)

*Primary Examiner* — Joseph J Hail
*Assistant Examiner* — Timothy B Brady
(74) *Attorney, Agent, or Firm* — M&B IP Analysts, LLC

(57) ABSTRACT

A toilet brush assembly is disclosed. The toilet brush assembly includes a hollow shaft body having an upper end and a bottom end, the bottom end includes a partially perforated surface, the hollow shaft body is adapted to accept a solid cleaning agent through the upper end of the hollow shaft body; and a plurality of bristles, the plurality of bristles is attached to the bottom end of the hollow shaft body.

10 Claims, 6 Drawing Sheets

(56) References Cited

U.S. PATENT DOCUMENTS

| | | | |
|---|---|---|---|
| 2017/0096807 | A1 | 4/2017 | Lock |
| 2017/0127890 | A1 | 5/2017 | Brittain |
| 2018/0042433 | A1 | 2/2018 | Shabat |
| 2018/0110381 | A1 | 4/2018 | Köllner |
| 2018/0140144 | A1 | 5/2018 | Music |
| 2019/0174977 | A1 | 6/2019 | Beeber |
| 2019/0307235 | A1 | 10/2019 | Tomalesky |

FOREIGN PATENT DOCUMENTS

| | | | | | |
|---|---|---|---|---|---|
| DE | 3104734 | A1 * | 9/1982 | ..... | A46B 11/0013 |
| DE | 10013495 | A1 * | 10/2001 | ..... | A46B 11/0013 |
| DE | 202015009203 | U1 | 11/2016 | | |
| EP | 0005685 | A1 * | 5/1978 | ..... | A46B 11/0013 |
| RU | 130811 | U1 | 8/2013 | | |
| SU | 1602439 | A1 | 10/1990 | | |
| WO | 0226081 | A1 | 4/2002 | | |
| WO | 03103468 | A1 | 12/2003 | | |

OTHER PUBLICATIONS

DE-3104734-A1 translation Espacenet (Year: 2021).*
DE-10013495-A1 translation Espacenet (Year: 2021).*
International Search Report and Written Opinion of International Searching Authority for PCT/US2020/061965, ISA/RU, Moscow, Russia, dated Jan. 26, 2021.

* cited by examiner

TOILET BRUSH ASSEMBLY

CROSS-REFERENCE TO RELATED APPLICATIONS

This application is a continuation of International Patent Application No. PCT/US2020/061965 filed on Nov. 24, 2020, which claims the benefit of U.S. Provisional Application No. 62/942,220 filed on Dec. 2, 2019, the contents of which are hereby incorporated by reference.

TECHNICAL FIELD

The present disclosure relates generally to a cleaning product, and specifically to a toilet brush assembly and a capsule containing a cleaning agent for use with a designated toilet brush.

BACKGROUND

Toilet brushes are commonly used in bathrooms to clean toilet bowls. However, existing toilet brushes have several disadvantages. Traditional toilet brushes do not permit a comprehensive cleaning of the toilet bowl, but only a superficial removal of some of the dirt while accumulation of bacteria is not prevented.

Therefore, it would be advantageous to provide a solution that overcomes the challenges noted above.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" or "certain embodiments" may be used herein to refer to a single embodiment or multiple embodiments of the disclosure.

Certain embodiments disclosed herein include a toilet brush assembly comprising a hollow shaft body having an upper end and a bottom end, wherein the bottom end further comprises a partially perforated surface, wherein the hollow shaft body is adapted to accept a solid cleaning agent through the upper end of the hollow shaft body; and a plurality of bristles, wherein the plurality of bristles is attached to the bottom end of the hollow shaft body.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1A:
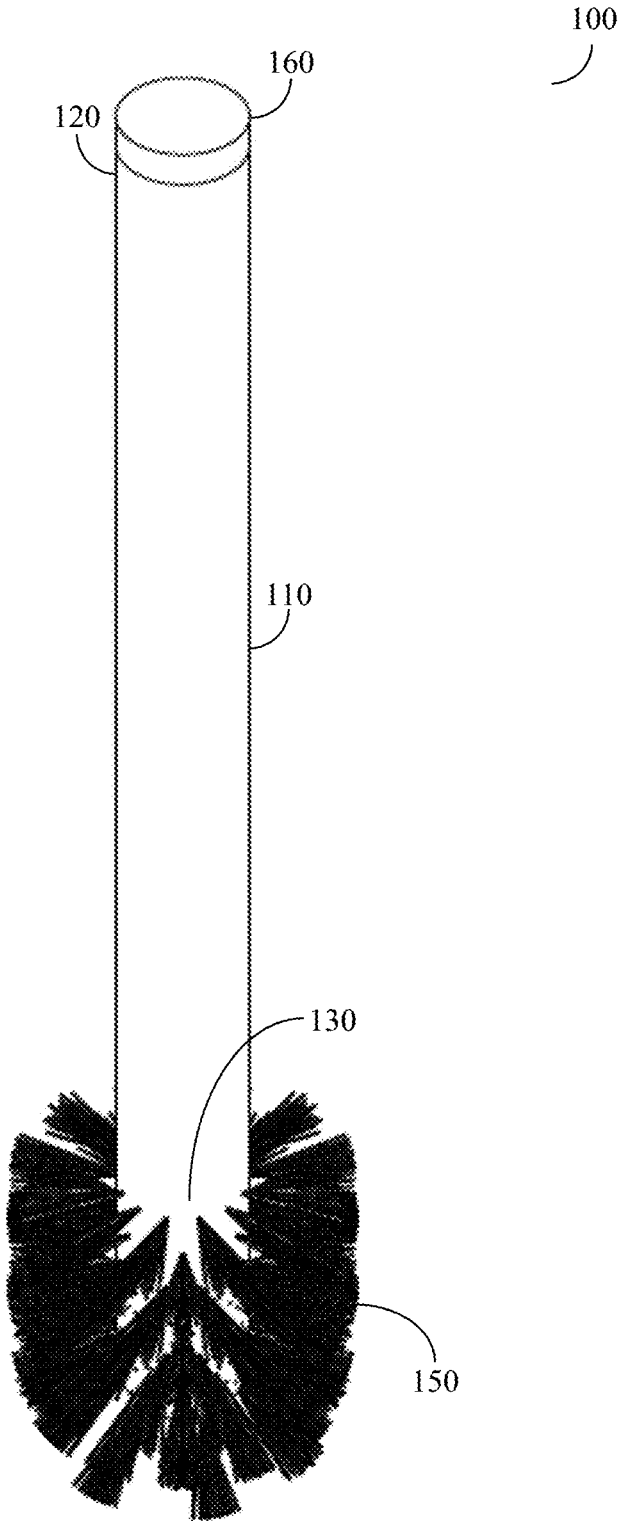
FIG. 1A shows an example isometric view of a toilet brush assembly, according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

A toilet brush assembly is disclosed. The toilet brush assembly includes a hollow shaft body having an upper end and a bottom end, the bottom end includes a partially perforated surface, the hollow shaft body is adapted to accept a solid cleaning agent through the upper end of the hollow shaft body; and a plurality of bristles, the plurality of bristles is attached to the bottom end of the hollow shaft body.

FIG. 1A shows an example isometric view of a toilet brush assembly 100, according to an embodiment. The toilet brush assembly 100 includes a hollow shaft body 110, having an upper end 120 and a bottom end 130. In an embodiment, the bottom end 130 includes at least a partially perforated surface (the perforated surface 140 shown in FIG. 1B). The toilet brush assembly 100 includes a set of bristles 150 that is attached to a portion of the bottom end 130.

In an embodiment, the upper end 120 is adapted to accept a detachable cap 160. The detachable cap 160 may be connected to the upper end 120 via, for example, a screwing. The detachable cap 160 is further described in FIGS. 5A and 5B.

Figure 1B:
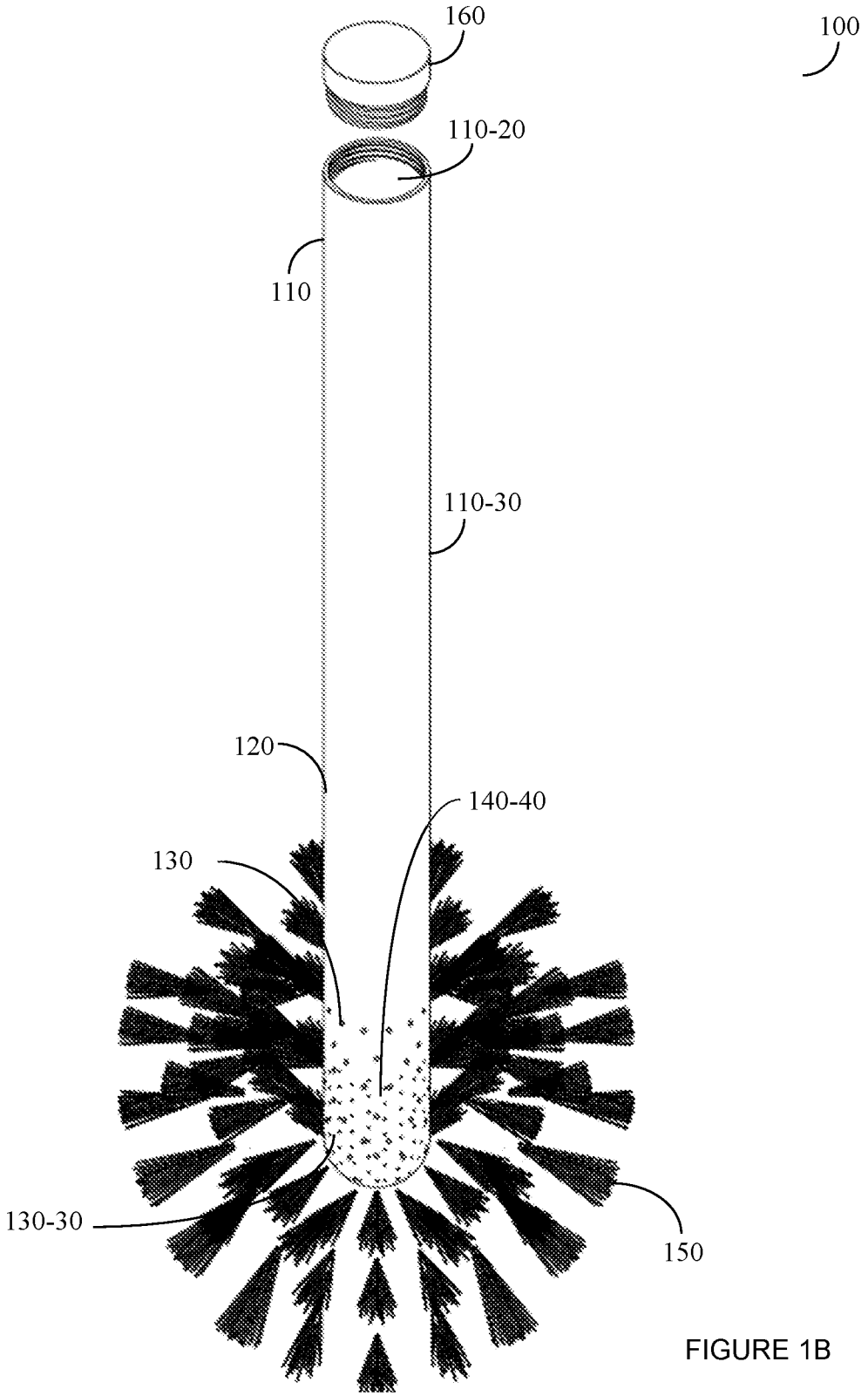
FIG. 1B shows an example isometric exploded of the toilet brush assembly, according to an embodiment.

FIG. 1B shows an example isometric exploded view of the toilet brush assembly 100, according to an embodiment. As further discussed hereinabove with respect to FIG. 1A, the toilet brush assembly 100 may include a perforated surface 140. In an embodiment, the perforated surface 140 may include a plurality of pores 140-40. In an embodiment, the toilet brush assembly includes a plurality of slits 130-30 that may be located at the bottom end 130.

It should be noted that the set of bristles 150 may be attached to a portion of the bottom end 130 via the plurality of slits 130-30. In an embodiment, the plurality of pores 140-40 and the plurality of slits 130-30 may be in close proximity to each other.

In an embodiment, the hollow shaft body 110 is adapted to accept therein a solid cleaning agent (shown in FIGS. 3 and 4) such as a solid cleanser, a solid disinfectant, a capsule that is composed of a cleaning agent such as a disinfectant, a sanitizer, and the like. The cleaning agent may be implemented as, for example and without limitation, a solid cleaning agent, a tablet, and the like. The cleaning agent in its solid form may be at a specific shape conforming a shape of the hollow shaft body 110.

The solid cleaning agent may be inserted through the upper end 120 along the hollow shaft body 110 and down to the bottom end 130. Thus, when the toilet brush assembly 100 is in use, the bottom end 130 comes into contact with the water that is located in the toilet bowl. The perforated surface 140 (e.g., the pores 140-40) that is located at the bottom end 130 allows the water to penetrate into the hollow shaft body 110 such that the solid cleaning agent, that is positioned within at least the bottom end 130, comes into contact with the water.

When the water contacts the solid cleaning agent the solid cleaning agent is at least partially dissolved. When at least a portion of the cleaning agent is dissolved, a mixed liquid (that includes a portion of the dissolved solid cleaning agent and the water) is generated and flows back through the perforated surface 140 and outside the bottom end 130. In an embodiment, the mixed liquid (e.g., a solution) flows back through the perforated surface 140 and outside the bottom end 130 when the hollow shaft body 110 rotates. The hollow shaft body 110 may be manually operated and therefore rotated, e.g., by a human that holds the hollow shaft body 110 near the upper end 120.

In an embodiment, when the mixed liquid flows back through the perforated surface 140 (e.g., the pores 140-40) and outside the bottom end 130, at least a portion of the set of bristles 150 comes into contact with the mixed liquid (dissolved cleaning agent) such that two goals are achieved. First, the set of bristles 150 has enhanced cleaning capability that involves a cleaning agent such as a disinfectant, a sanitizer, and the like. Thus, the traditional cleaning process of the toilet bowl (sides, bottom and the water located within the toilet bowl) becomes more comprehensive using the toilet brush assembly 100 that contains the solid cleaning agent. The second achieved goal is keeping the set of bristles 150 clean and disinfected after use. Another advantage of the disclosed toilet brush assembly 100 is that even the base (a traditional base; not shown) in which the toilet brush assembly 100 is placed after use, may be kept clean and disinfected due to the fact that the set of bristles 150 is clean and disinfected after use.

In an embodiment, the hollow shaft body 110 includes an inner wall 110-20 and an outer wall 110-30. The inner wall 110-20 and the outer wall 110-30 may have identical or different diameters along the hollow shaft body 110. That is, the hollow shaft body 110 may be designed in different shapes. For example, some portions of the hollow shaft body 110 may be narrow compared to other portions of the hollow shaft body 110 that may be wider.

Figure 2:
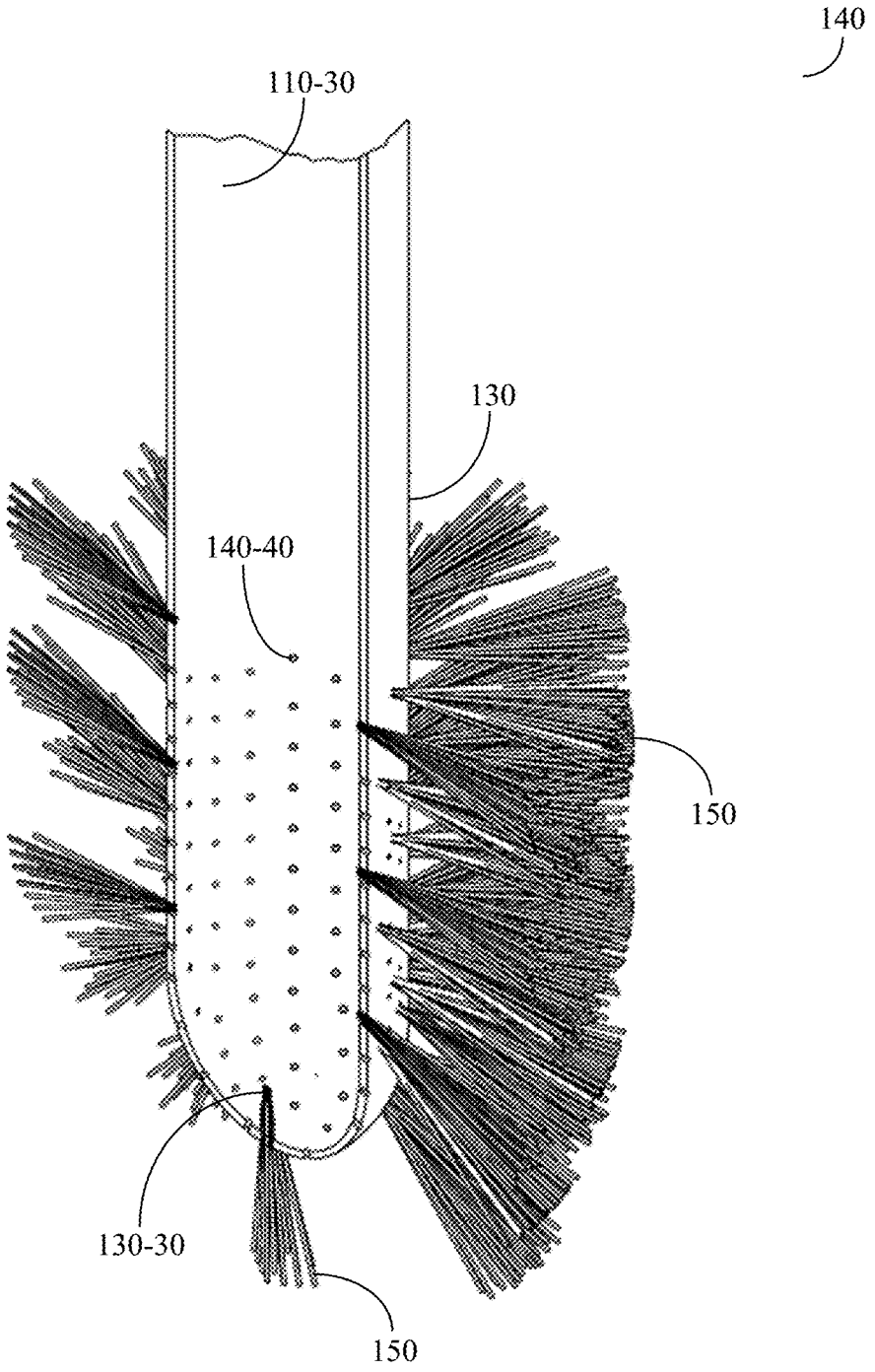
FIG. 2 shows an example isometric section view of a perforated surface of the toilet brush assembly, according to an embodiment.

FIG. 2 shows an example isometric section view of a perforated surface 140 of the toilet brush assembly 100, according to an embodiment. As noted above, the perforated surface 140 may include a plurality of pores 140-40 that are used for enabling the water to penetrate into the hollow shaft body 110 and therefore come into contact with the solid cleaning agent (shown in FIGS. 3 and 4). The plurality of pores 140-40 may also be used for enabling the generated mixed liquid (i.e., water and the dissolved solid cleaning agent) to flow outside the hollow shaft body 110. FIG. 2 also shows the inner wall 110-30 of the hollow shaft body 110. The plurality of slits 130-30 that was further discussed herein above with respect to FIG. 1B are also shown in FIG. 2. The set of bristles 150 are attached to the plurality of slits 130-30. In an embodiment, the plurality of pores 140-40 and the plurality of slits 130-30 may be in close proximity.

According to an alternative embodiment, the bottom end 130 includes at least one first opening (not shown) instead of the perforated surface 140. The at least one first opening may allow the water located at the toilet bowl to be collected from the toilet bowl into the bottom end 130 which contains the solid cleaning agent. The at least one first opening is designed to efficiently collect water from the toilet bowl when the toilet brush assembly 100 rotates and the at least one first opening is at least partially covered with water of the toilet bowl.

In a further embodiment, the perforated surface 140 includes at least one second opening allowing the above-mentioned mixed liquid (i.e., water and the dissolved solid cleaning agent) to flow from within the bottom end 130 and outside to the water located at the toilet bowl, such that the water in the toilet bowl is mixed with the mixed liquid.

In an embodiment, the at least one first opening is larger than the at least a second opening. In an embodiment the at least one first opening and the at least a second opening have the same size. In an embodiment the at least one first opening and the at least a second opening are utilized for the same purpose. That is, the at least a first opening (or the at least a second opening) is used for allowing water to enter into the bottom end 130 and also allowing the above-mentioned mixed liquid to flow out of the hollow shaft body 110 to the water located in the toilet bowl.

Figure 3:
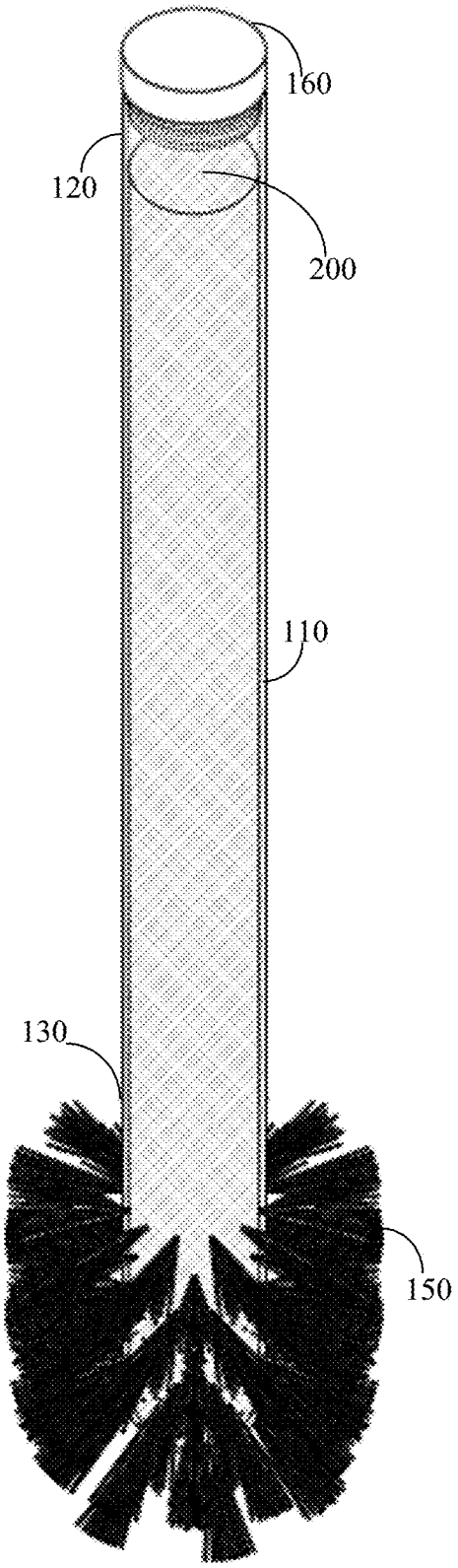
FIG. 3 shows an example isometric view of the toilet brush assembly including a solid cleaning agent, according to an embodiment.

FIG. 3 shows an example isometric view of the toilet brush assembly 100 including a solid cleaning agent 200, according to an embodiment. The hollow shaft body 110 may be adapted to accept therein at least one solid cleaning agent 200. The solid cleaning agent 200 may be inserted the through the upper end 120 along the hollow shaft body 110 and down to the bottom end 130 as further discussed herein above with respect to FIG. 1B. For example, the solid cleaning agent 200 may include a solid cleanser, a solid disinfectant, and the like. In an embodiment, the solid cleaning agent 200 may be implemented as a capsule. In an embodiment, the detachable cap 160 may be detached from the upper end 120 for facilitate insertion of the solid cleaning agent 200 through the upper end 120 through the hollow shaft body 110 down to the bottom end 130.

Figure 4:
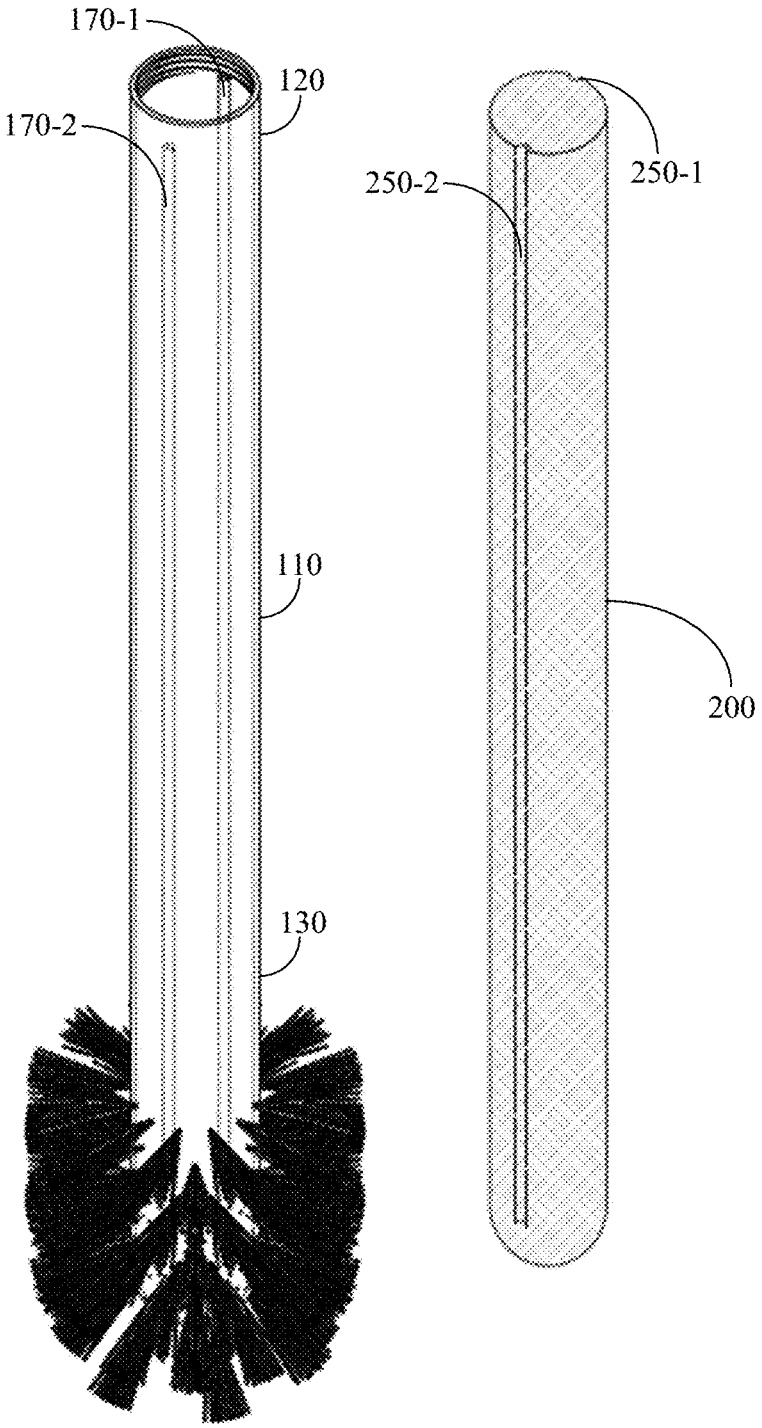
FIG. 4 shows an example isometric view of a solid cleaning agent and a toilet brush assembly including at least one track that is adapted to guide the solid cleaning agent into a hollow shaft body of the toilet brush assembly, according to an embodiment.

FIG. 4 shows an example isometric view of a solid cleaning agent 200 and a toilet brush assembly 100 including at least one track 170 that is adapted to guide the solid cleaning agent 200 into the hollow shaft body 110 of the toilet brush assembly 100, according to an embodiment. In an embodiment, the hollow shaft body 110 includes one or more tracks 170-1 and 170-2 that are attached to the inner wall (e.g., the inner wall 110-20 shown in FIG. 1B) of the hollow shaft body 110. The one or more tracks 170-1, 170-2 may be positioned horizontally with respect to the inner walls (e.g., the inner wall 110-20) of the hollow shaft body 110 along at least a portion of the hollow shaft body 110. The one or more tracks 170-1, 170-2 are designed to guide the solid cleaning agent 200 from the upper end 120 through the hollow shaft body 110 and to the bottom end 130. In an embodiment, the one or more tracks 170-1, 170-2 may be positioned throughout (from the upper end 120 to the bottom end 130) the hollow shaft body 110. Alternatively, the one or more tracks 170-1, 170-2 may be positioned in a fragmented form. According to another embodiment, the one or more tracks 170-1, 170-2 may be positioned in at least a portion of the hollow shaft body 110.

In an embodiment, each of the one or more tracks 170-1, 170-2 may be designed to accept thereto a slit 250 (e.g., the slit 250-1 and the slit 250-2) of the solid cleaning agent 200. That is, the solid cleaning agent 200 may include one or more slits 250 and each one of the slits 250 is designed to fit into the one or more tracks 170-1, 170-2 that are attached to the inner wall (e.g., the inner wall 110-20) of the hollow shaft body 110, such that the solid cleaning agent 200 may be guided downwards and towards the bottom and 130 when inserted into the hollow shaft body 110.

In an embodiment, the one or more tracks 170-1, 170-2 allow to stabilize the solid cleaning agent 200 within the hollow shaft body 110 such that when the hollow shaft body 110 rotates, the solid cleaning agent 200 rotates at the same rotation speed. That is, the tracks 170-1, 170-2 allow to transfer the rotation speed of the hollow shaft body 110 to the solid cleaning agent 200 and maintain the rotation speed of the solid cleaning agent 200 as long as the hollow shaft body 110 rotates.

It should be noted that the rotation speed of the hollow shaft body 110 may affect the friction level between the water (located at the toilet bowl) and the solid cleaning agent 200 when the water contacts the solid cleaning agent 200. Thus, when the rotation speed is relatively high the friction level between the water (located at the toilet bowl) and the solid cleaning agent 200 is also relatively high. When the friction is high, more of the abovementioned mixed liquid (i.e., water and the dissolved solid cleaning agent 200) is released and flows through the perforated surface 140 and/or the at least one first opening or second opening, as further discussed herein above.

Figure 5A:
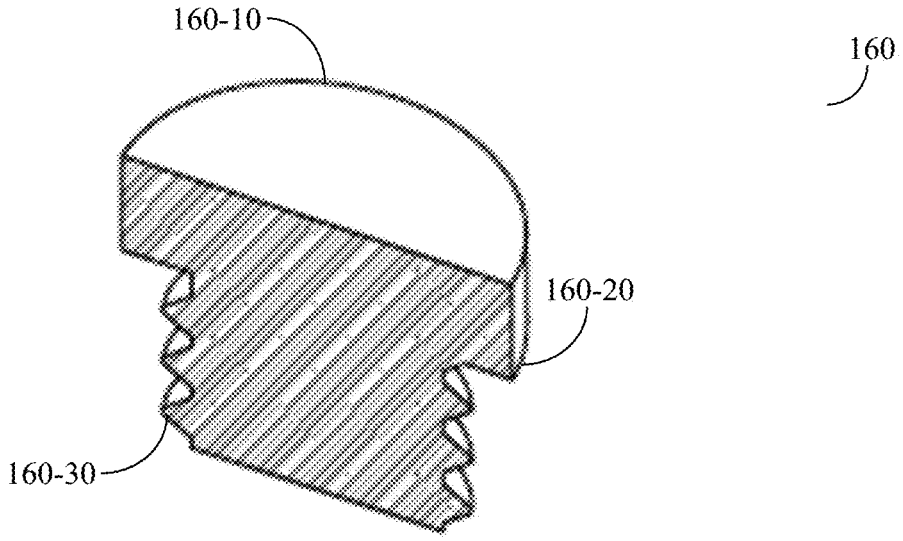
FIG. 5A shows an example isometric section view of a detachable cap that is adapted to lock the solid cleaning agent within the toilet brush assembly, according to an embodiment.
Figure 5B:
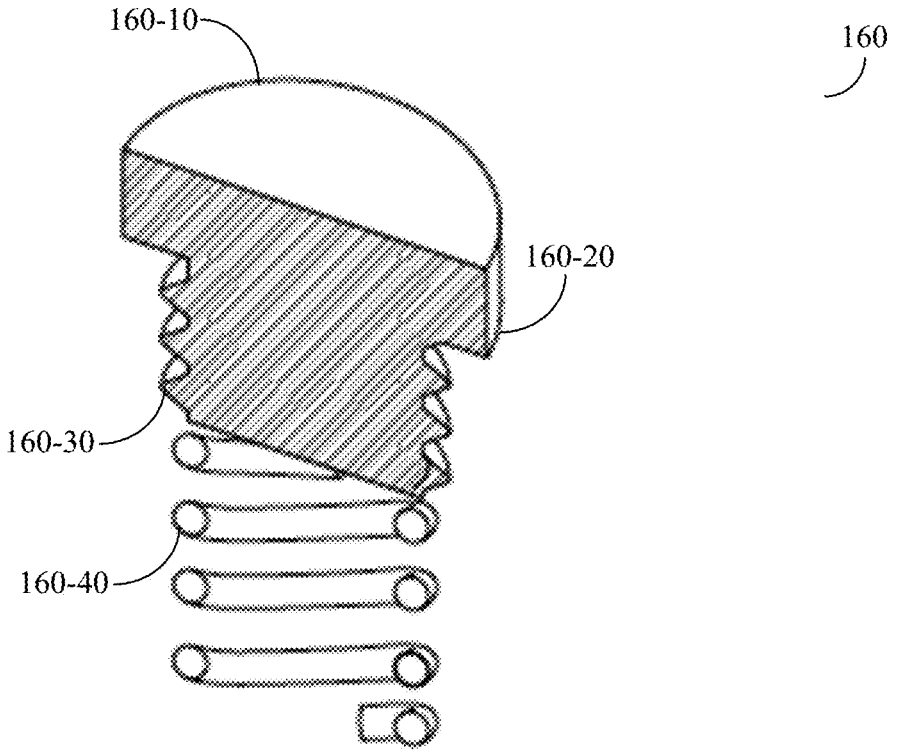
FIG. 5B shows an example isometric section view of a detachable cap including a spring that is adapted to push the solid cleaning agent downwards and towards a perforated surface of the toilet brush assembly, according to an embodiment.

FIG. 5A-5B show an example isometric section view of a detachable cap 160 that is adapted to lock the solid cleaning agent within the toilet brush assembly, according to an embodiment.

In an embodiment, the detachable cap 160 includes an upper end 160-10 and a bottom end 160-20. The bottom end 160-20 is adapted to be attached and detached with respect to the upper end 120 of the toilet brush assembly 100. In an embodiment, the detachable cap 160 includes a screwing 160-30 (or any other mechanical element) allowing the detachable cap 160 to be attached and detached with respect to the upper end 120 of the toilet brush assembly 100.

Reference is now made to FIG. 5B in which a spring 160-40 is connected to a screw 160-30 that may be an integral part of the detachable cap 160. According to another embodiment, the spring 160-40 is directly connected to the bottom end 160-20 of the detachable cap 160.

The spring 160-40 may be used for constantly pushing the solid cleaning agent 200 downwards and towards the bottom end 130 of the toilet brush assembly 100. It should be noted that the spring 160-40 may be used for stabilizing the solid cleaning agent 200 within the hollow shaft body 110. Stabilizing the solid cleaning agent 200 is essential for enabling the water of the toilet bowl to penetrate through the perforated surface 140 (or at least one of the first and second opening) and into the bottom end 130 without causing the solid cleaning agent 200 to be lifted upwards because of the water resistance.

Such water resistance may be caused when the toilet brush assembly 100 is pushed downwards and towards the water that are located within the toilet bowl. According to one embodiment, the detachable cap 160 may include a safety lock mechanism that is designed to prevent children from being able to easily open the detachable cap 160 and therefore be exposed to the solid cleaning agent 200.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions. Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

A person skilled-in-the-art will readily note that other embodiments of the disclosure may be achieved without departing from the scope of the disclosed disclosure. All such embodiments are included herein. The scope of the disclosure should be limited solely by the claims thereto.

As used herein, the phrase "at least one of" followed by a listing of items means that any of the listed items can be utilized individually, or any combination of two or more of the listed items can be utilized. For example, if a system is described as including "at least one of A, B, and C," the system can include A alone; B alone; C alone; 2A; 2B; 2C; 3A; A and B in combination; B and C in combination; A and C in combination; A, B, and C in combination; 2A and C in combination; A, 3B, and 2C in combination; and the like.

What is claimed is:

1. A toilet brush assembly, comprising:

a hollow shaft body having an upper end and a bottom end, wherein the hollow shaft body includes an inner wall, wherein the bottom end further comprises a partially perforated surface, wherein the hollow shaft body is adapted to accept a solid cleaning agent through the upper end of the hollow shaft body, wherein at least one track is projecting from and positioned substantially along the length of the inner wall of within the hollow shaft body, wherein the at least one track is designed to accept at least one slit of the solid cleaning agent, wherein the at least one track is adapted to stabilize the solid cleaning agent within the hollow shaft body; and a plurality of bristles, wherein the plurality of bristles is attached to the bottom end of the hollow shaft body.

2. The toilet brush assembly of claim 1, wherein the partially perforated surface is adapted to enable water to penetrate the hollow shaft body such that the water comes in contact with the solid cleaning agent.

3. The toilet brush assembly of claim 1, wherein the partially perforated surface is designed to enable liquid to flow outside from within the hollow shaft body, wherein the liquid is a solution of the solid cleaning agent and water.

4. The toilet brush assembly of claim 1, wherein the at least one track is adapted to guide the solid cleaning agent through the upper end of the hollow shaft body down to the bottom end of the hollow shaft body.

5. The toilet brush assembly of claim 1, wherein the at least one track is adapted to transfer a rotation speed of the hollow shaft body to the solid cleaning agent.

6. The toilet brush assembly of claim 1, further comprising:

at least one first opening, wherein the at least one first opening is adapted to enable water to penetrate the hollow shaft body.

7. The toilet brush assembly of claim 1, further comprising:

at least one second opening, wherein the at least one second opening is adapted to enable liquid to flow outside from within the hollow shaft body, wherein the liquid is a solution of the solid cleaning agent and water.

8. The toilet brush assembly of claim 1, wherein the solid cleaning agent is shaped in a predetermined shape.

9. The toilet brush assembly of claim 1, wherein the upper end is adapted to accept a detachable cap.

10. The toilet brush assembly of claim 9, wherein the detachable cap further comprises a spring that is attached to a bottom end of the detachable cap, wherein the spring is adapted to constantly push the solid cleaning agent downward and towards the bottom end of the hollow shaft body.

* * * * *